US008107852B2

(12) United States Patent
Ito

(10) Patent No.: US 8,107,852 B2
(45) Date of Patent: Jan. 31, 2012

(54) IMAGE FORMING APPARATUS INCLUDING IMAGE READING UNIT WITH CONTACTING PORTIONS WHICH CONTACT CONTACTED PORTIONS WHEN CLOSING THE IMAGE READING UNIT

(75) Inventor: Sakae Ito, Kitanagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 1131 days.

(21) Appl. No.: 11/924,710

(22) Filed: Oct. 26, 2007

(65) Prior Publication Data

US 2008/0100872 A1 May 1, 2008

(30) Foreign Application Priority Data

Oct. 26, 2006 (JP) ..... 2006-291393

(51) Int. Cl.
*G03G 15/00* (2006.01)

(52) U.S. Cl. ..... 399/110; 399/107; 399/125

(58) Field of Classification Search ..... 399/125, 399/110, 107, 124
See application file for complete search history.

(56) References Cited

U.S. PATENT DOCUMENTS 6,057,936 A 5/2000 Obara et al.
6,741,820 B2 * 5/2004 Nobe et al. ..... 399/110
2005/0031371 A1 * 2/2005 Kaida et al. ..... 399/110
2006/0088336 A1 4/2006 Hirose et al.
2007/0071492 A1 * 3/2007 Ito ..... 399/107

FOREIGN PATENT DOCUMENTS

JP 10-301349 A 11/1998
JP 2005-234222 A 9/2005
JP 2005-258025 A 9/2005
JP 2005-301154 A 10/2005
JP 2006-33887 A 2/2006
JP 2006-065188 A 3/2006
JP 2006-119474 A 5/2006

OTHER PUBLICATIONS

JP Office Action dtd Sep. 18, 2008, JP Appln. 2006-291393 (partial translation).

* cited by examiner

*Primary Examiner* — Sophia S Chen
(74) *Attorney, Agent, or Firm* — Banner & Witcoff, Ltd.

(57) ABSTRACT

An image forming apparatus includes an image forming unit and an image reading unit. The image forming unit may include a receiving portion disposed above an image forming part, and a pair of contacted portions disposed on opposite sides on the image forming part. The image reading unit may be disposed above the image forming unit and configured to open to expose the receiving portion and configured to close to cover the receiving portion. The image reading unit may include a pair of contacting portions disposed on opposite sides of an image reading portion, extending downward toward the image forming unit, and being configured to contact the contacted portions when the image reading unit is closed, and a first gripping portion horizontally protruding from the image reading portion and extending toward its opposite sides.

20 Claims, 5 Drawing Sheets

IMAGE FORMING APPARATUS INCLUDING IMAGE READING UNIT WITH CONTACTING PORTIONS WHICH CONTACT CONTACTED PORTIONS WHEN CLOSING THE IMAGE READING UNIT

CROSS REFERENCE TO RELATED APPLICATION

This application claims priority from Japanese Patent Application No. 2006-291393, filed on Oct. 26, 2006, the entire subject matter of which is incorporated herein by reference.

FIELD

Aspects of the invention relate to an image forming apparatus such as a laser printer.

BACKGROUND

An image forming apparatus such as a laser printer integrally includes a scanner unit for scanning image information on a document and an image forming unit for forming the image information scanned by the scanner unit on a recording sheet. The image forming apparatus is commercially available as a copier, a digital multifunction apparatus provided with facsimile/network communication function, and a printer.

The image forming apparatus includes a receiving portion formed between the scanner unit and the image forming unit that is disposed under the scanner unit such that a recording sheet on which image has been formed is to be ejected and stacked on the receiving portion. As the recording sheet is ejected in the image forming apparatus, the installation area of the image forming apparatus can be decreased.

A housing of the image forming unit is coupled to a housing of the scanner unit via a hinge portion such that the scanner unit is configured to open and close with respect to the image forming unit. When the scanner unit is closed, the receiving portion is created in a central portion with respect to a width direction of an ejected recording sheet, and contacts the image forming unit at both ends of the scanner unit with respect to the width direction. When the scanner unit is opened, both ends of the scanner unit are separated from the image forming unit, the receiving portion is opened upward, and a stack of ejected recording sheets can be removed.

The image forming apparatus is provided with a gripping portion for opening and closing the scanner unit at a central portion corresponding to the receiving portion in the sheet width direction. The gripping portion is disposed such that the front end of the gripping portion is aligned with the front ends of both ends of the scanner unit. In the scanner unit, the gripping portion and both ends of the scanner unit smoothly continue without any steps. When the scanner unit is closed, the user may hold either one of the ends of the scanner unit. Even when the user holds the gripping portion at the central portion in the sheet width direction, his/her hand holding the gripping portion may accidentally slide to either one of the ends of the scanner unit. If the scanner unit is closed while the user holds either one of the ends of the scanner unit, his/her hand may be caught between the scanner unit and the image forming unit. The operability related to opening and closing the scanner unit may become impaired.

SUMMARY

Aspects of the invention may provide an image forming apparatus configured to enhance its operability.

BRIEF DESCRIPTION OF THE DRAWINGS

Illustrative aspects of the invention will be described in detail with reference to the following figures in which like elements are labeled with like numbers and in which.

DETAILED DESCRIPTION

An illustrative embodiment of the invention will be described in detail with reference to the accompanying drawings. An image forming apparatus according to aspects of the invention is applied to a laser printer in this illustrative embodiment. It will be appreciated that aspects of the invention apply to other types of image forming apparatuses as well.

The general structure of an illustrative laser printer 1 will be described with reference to FIGS. 1-5.

For ease of discussion, in the following description, the top or upper side, the bottom or lower side, the left or left side, the right or right side, the front or front side, and the rear or rear side of the laser printer 1 will be identified as indicated by the arrows in FIG. 1. With regard to various individual objects of the laser printer 1, sides of the individual objects will be similarly identified based on the arranged/attached position of the object on/in the laser printer 1 shown in FIG. 1. The top and bottom direction may be referred to as a height direction, and the left and right direction may be referred to as a width direction.

Figure 1:
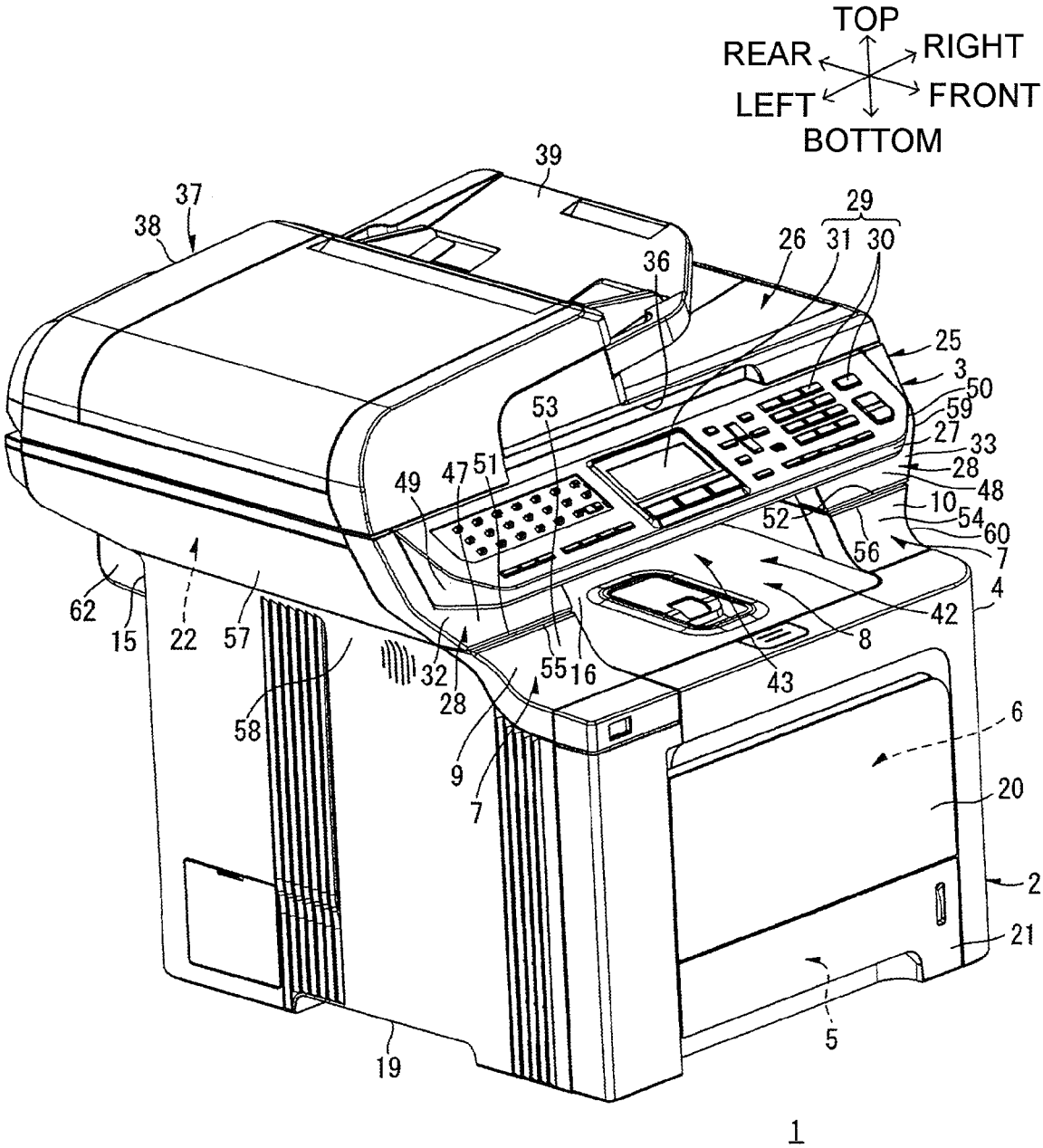
FIG. 1 is a left perspective view of a laser printer viewed from front-top side, according to an illustrative embodiment, in which a scanner unit is in a closed position.

As shown in FIG. 1, the laser printer 1 is substantially box shaped and is slightly long vertically, and more specifically, is substantially T shaped in a front view. The laser printer 1 is a multifunction apparatus, and includes an image forming unit 2, and a scanner unit 3 disposed above the image forming unit 2. The scanner unit 3 is free to open and close with respect to the image forming unit 2.

The image forming unit 2 is substantially box shaped and is slightly long in the front and rear direction. The image forming unit 2 includes a printer housing 4, a feeder unit 5 disposed in a lower portion of the printer housing 4, and an image forming part 6 disposed in an upper portion of the printer housing 4.

The printer housing 4 forms an outer frame of the image forming unit 2, and is substantially box shaped and is slightly long in the front and rear direction. More specifically, the front, rear, left, and right surfaces of the printer housing 4 are vertical planes, and the top and bottom surfaces are horizontal planes. On the top surface of the printer housing 4, a pair of leg receiving portions 7 and a receiving portion 8 are provided as illustrative contacted portions.

Figure 4:
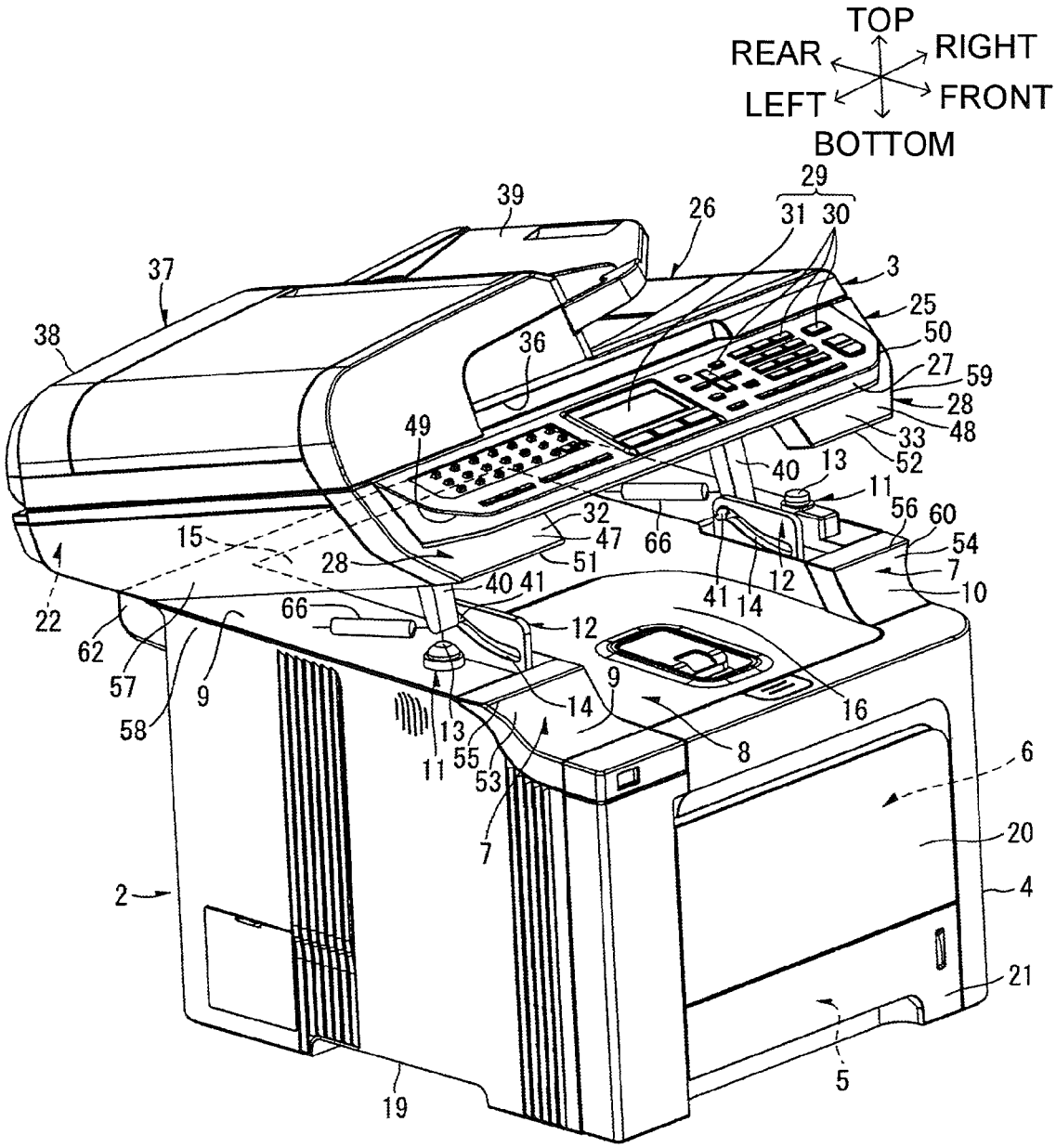
FIG. 4 is a perspective view of the laser printer of FIG. 1 in which the scanner unit is in an open position.

As shown in FIG. 4, the leg receiving portion 7 is located above the image forming part 6. The leg receiving portion 7 protrudes upward continuously from the left and right ends of the printer housing 4 toward the rear end, and is U-shaped, that is recessed rearward in a plan view. The front end of the leg receiving portion 7 is located behind the front end of the printer housing 4. The top surface of the leg receiving portion 7 is a flat surface in the horizontal direction. In the leg receiving portion 7, a left end portion located on the top surface of the printer housing 4 is defined as a left leg receiving portion 9, a right end portion located on the top surface of the printer housing 4 is defined as a right leg receiving portion 10, and a rear end portion located on the top surface of the printer housing 4 is defined as a rear leg receiving portion 15. The left and right leg receiving portions 9, 10 are long in the front and rear direction and are substantially box shaped. The rear leg receiving portion 15 is long in the width direction and is substantially box shaped.

Figure 2:
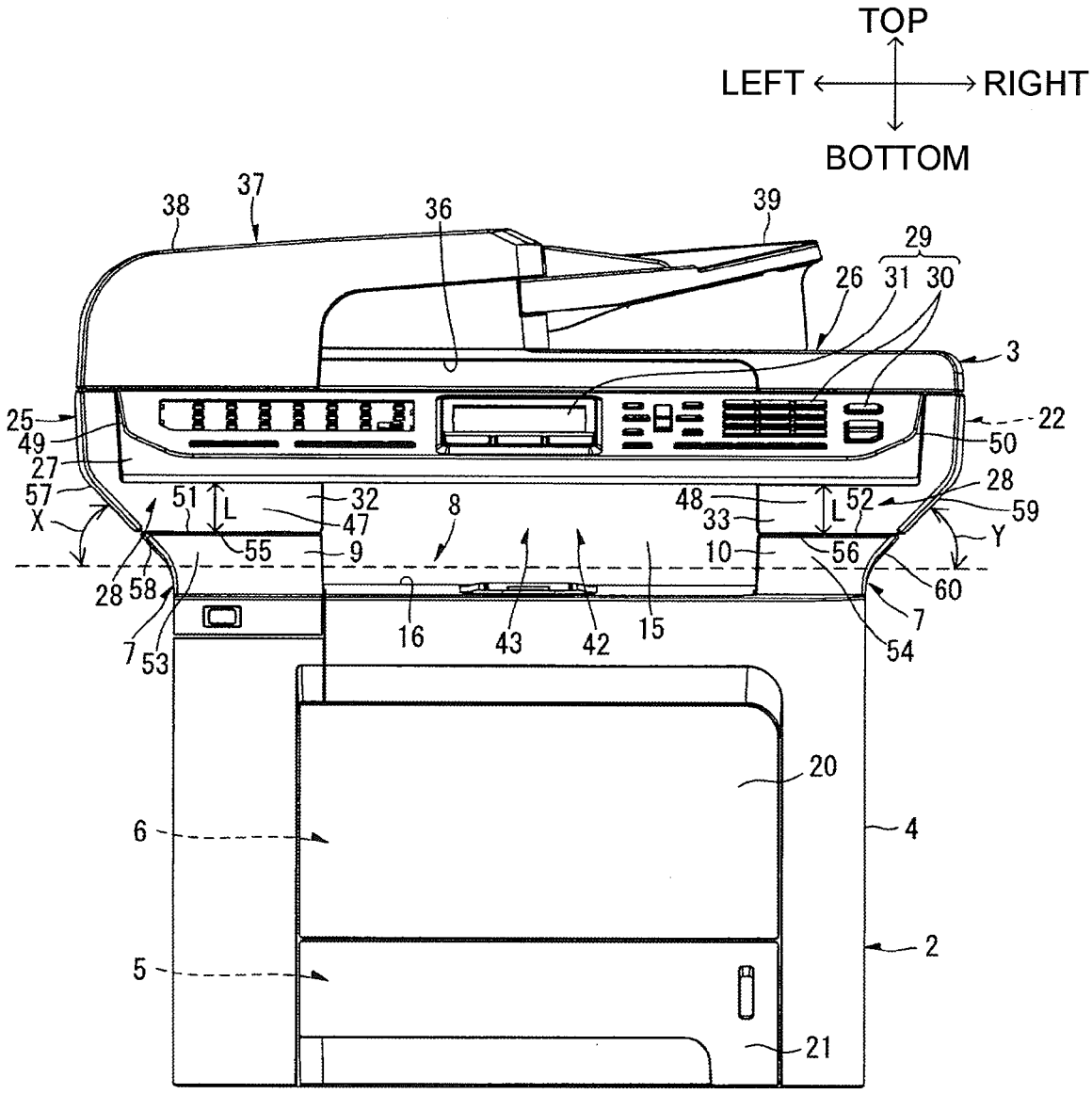
FIG. 2 is a front view of the laser printer of FIG. 1.
Figure 5:
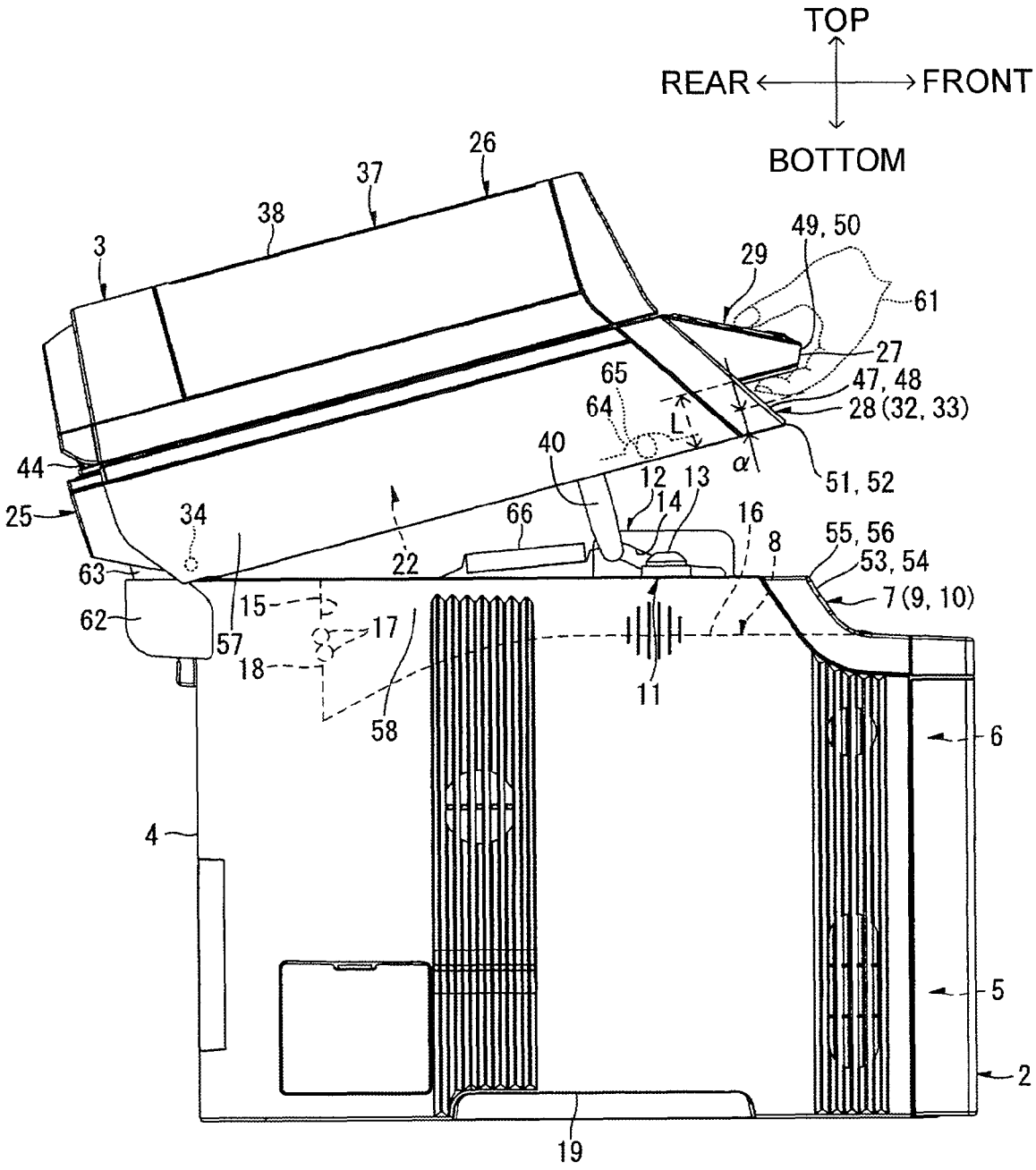
FIG. 5 is a left side view of the laser printer of FIG. 3, in which the scanner unit is in the open position.

As shown in FIG. 5, front end surfaces 53, 54 of the left and right leg receiving portions 9, 10 are formed to have a smooth arc in a side view by extending from their upper ends downwardly toward the front and are continuously connected to the top surface of the printer housing 4. As shown in FIG. 2, a left side surface 58 and a right side surface 60, which are outer surfaces of the left and right leg receiving portions 9, 10, are bent in an arc from their lower ends toward their upper ends. Inner surfaces of the left and right leg receiving portions 9, 10 are vertical planes. As shown in FIG. 4, positioning bosses 11 and lever supporting portions 12 are disposed in front sides of the top surfaces of the left and right leg receiving portions 9, 10. The positioning bosses 11 are hollow and substantially dome-shaped or cylindrical that protrudes upward. The positioning bosses 11 include lock holes 13 on the top ends. The interior of each positioning boss 11 is exposed from the lock holes 13. The lever supporting portions 12 are located in interior sides from the positioning bosses 11 and formed in a rectangular plate shape in a side view. The lever supporting portions 12 are formed with guide grooves 14 that pass through the thickness direction and extend like an arc in a side view. As shown in FIG. 5, an ejection opening 18 is formed on the front side of the rear leg receiving portion 15. The ejection opening 18 is rectangular-shaped that is long in the width direction in a front view. A printer-side hinge 34 is provided in a substantially central portion of the rear leg receiving portion 15 in the front and rear direction. A printer-side harness storing portion 62 is provided in the rear end portion of the rear leg receiving portion 15. In the printer-side harness storing portion 62, an exposed portion of a wire harness (not shown) connecting the image forming unit 2 and the scanner unit 3 is stored. This prevents the wire harness (not shown) in the printer-side harness storing portion 62 from being extended when the scanner unit 3 is pivoted.

As shown in FIG. 4, the receiving portion 8 is disposed above the image forming part 6 and sandwiched between the left and right leg receiving portions 9, 10 paired in the width direction. As indicated by a broken line of FIG. 5, the receiving portion 8 can include a sheet input portion 16 and a pair of ejection rollers 17. The sheet input portion 16 is formed as a curved surface continuing from the front end of the upper surface of the printer housing 4 and sinking rearward. The sheet input portion 16 continues to the front surface of the rear leg receiving portion 15 at its deepest portion (rear end). The ejection rollers 17 are long in the width direction, and disposed vertically in contact with each other in the ejection opening 18. The ejection rollers 17 are configured to be rotated and driven by a drive force from a drive source (not shown) in the image forming unit 2. A recording sheet on which an image has been formed in the image forming part 6 is fed from rear to front by the ejection rollers 17 and ejected onto the sheet input portion 16 of the receiving portion 8 via the ejection opening 18.

Carrying gripping portions 19 functioning as a second gripping portion are formed at lower ends of the left and right surface of the printer housing 4. More specifically, the lower ends of the left and right surfaces of the printer housing 4 are formed in a substantially inverse U shape in a side view in a substantially central portion in the front and rear direction. The carrying gripping portions 19 are located below a contact position between a leg portion 28 and the leg receiving portion 7, and configured to be held when the laser printer 1 is transported.

As shown in FIG. 1, a first cover 20 and a second cover 21 are disposed, in this order from above, on the front surface of the printer housing 4. The first cover 20 and the second cover 21 are configured to open and close. When the first cover 20 is opened, the image forming part 6 is exposed to the front. When the second cover 21 is opened, the feeder unit 5 is exposed to the front.

A stack of recording sheets for image formation is stored in the feeder unit 5. The recording sheets are separated singly and supplied to the image forming part 6. When the second cover 21 is opened to expose the feeder unit 6, another stack of recording sheets is supplied to the feeder unit 5.

In the image forming part 6, image information is inputted from the scanner unit 3. In the image forming part 6, an image based on the image information is formed onto a recording sheet supplied from the feeder unit 5.

As shown in FIG. 2, the scanner unit 3 is substantially box shaped, and is longer in the width direction than the image forming unit 2. The scanner unit 3 includes a document base 25 as an illustrative image reading portion and a document holding cover 26 configured to be supported by the document base 25 pivotally.

Figure 3:
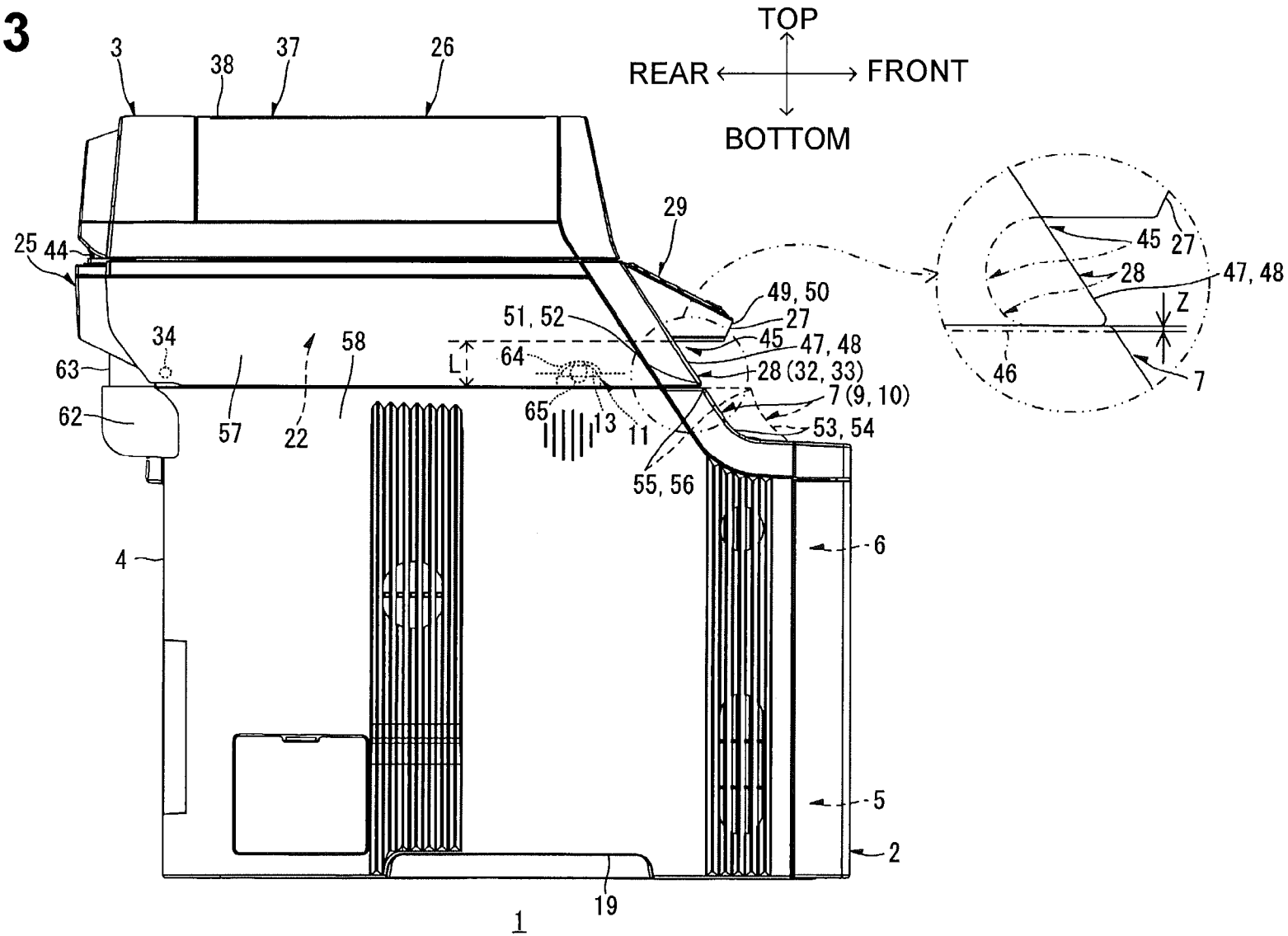
FIG. 3 is a left side view of the laser printer of FIG. 1.

The document base 25 is formed in a rectangle in a plan view, and is thick. The left and right sides of the document base 25 extend further outward than those of the image forming unit 2. As shown in FIG. 3, the front end surface of the document base 25 is an inclined surface extending flat downwardly toward the front. The top surface of the document base 25 is formed with a glass surface (not shown) on which a document is placed. The document base 25 includes an image reading unit 22 for reading image information of a document placed on the glass surface. The image reading unit 22 includes a CCD sensor (not shown) for reading image information of a document, and a main-scanning motor (not shown) for scanning the CCD sensor as opposed to the glass surface (not shown). Image information read by the CCD sensor (not shown) is outputted to the image forming part 6.

The document base 25 includes a gripping portion 27 and a pair of leg portions 28 functioning as illustrative contacting portions. The leg portion 28 is disposed on a bottom surface of the gripping portion 27. A rear end of a bottom surface of the document base 25 is coupled to the printer-side hinge 34 of the image forming unit 2. A scanner-side harness storing portion 63 is provided behind the printer-side hinge 34 in the document base 25. In the scanner-side harness storing portion 63, the wire harness (not shown) extending from the printer-side harness storing portion 62 is stored. The wire harness (not shown) extends from the scanner-side harness storing portion 63, and is connected to each electronic component disposed in the scanner unit 3.

The gripping portion 27 horizontally protrudes frontward from the document base 25, and is formed in a substantially triangular prism that is long in the width direction. More specifically, in a side view, a rear end surface of the gripping portion 27 is connected to the front end surface of the document base 25, and the top surface of the gripping portion 27 extends continuously from the upper end of the front end surface of the document base 25 downwardly to the front. In addition, the bottom surface of the gripping portion 27 is continuously connected with a lower end of the front end surface of the document base 25 (FIG. 2), extends horizontally and upward to the front, and is connected to the front end of the top surface of the gripping portion 27. An operation section 29 is disposed on the top surface of the gripping portion 27. As shown in FIG. 4, the operation section 29 includes operation buttons 30 and a display screen 31. A user operates the operation buttons 30 to effect a specified operation of the laser printer 1. The display screen 31 shows an operation status of the laser printer 1.

The leg portion 28 protrudes downward (or toward the image forming unit 2) from a left end portion, a right end portion, and a rear end portion on the bottom surface of the document base 25, which are connected in a U shaped manner in a bottom plan view. The bottom surface of the leg portion 28 is a flat surface along the bottom surface of the document base 25. The leg portion 28 is made up of a left leg portion 32 located on the left end on the bottom surface of the document base 25, and a right leg portion 33 located on the right end on the bottom surface of the document base 25. The left and right leg portions 32, 33 are formed in a substantially rectangular parallelepiped, which is long in the front and rear direction. The left and right leg portions 32, 33 are spaced away from each other in the width direction to sandwich the receiving portion 8 therebetween in a plan view. Front end surfaces 47, 48 of the left and right leg portions 32, 33 are inclined surfaces protruding to the front from upper ends to lower ends (FIG. 3). As shown in FIG. 2, outer surfaces of the left and right leg portions 32, 33 in the width direction are the left side surface 57 and the right side surface 59 inclining outwardly in the width direction from their lower ends to upper ends and extending smoothly and continuously with the lower end of the document base 25. Inner surfaces of the left and right leg portions 32, 33 are vertical planes. Both ends of the gripping portion 27 in the width direction are located at positions corresponding to the left side surface 57 and the right side surface 59 of the left and right leg portions 32, 33. More specifically, both ends of the gripping portion 27 in the width direction are a left end portion 49 and a right end portion 50, which are separated by a space corresponding to a distance L measured upward from lower ends 51, 52 of the left and right end portions 32, 33.

As shown in FIG. 4, substantially column-shaped guide levers 40 protrude downward at front sides of the bottom surfaces of the left and right leg portions 32, 33. The guide levers 40 are arranged facing each other in the width direction. Each guide lever 40 is fixed, at one end, to a corresponding one of the left and right leg portions 32, 33, and is configured to slide in the front and rear direction about one end. Each guide lever 40 is integrally formed with a corresponding guide shaft 41 protruding inward at the lower end of the guide lever 40. Each guide shaft 41 is slidably engaged in a guide groove 14 of the corresponding lever supporting portion 12 of the image forming unit 2. One end of a coil spring 66 is connected to the lower end portion of the corresponding guide lever 40 in the vicinity of the guide shaft 41. The other end of each coil spring 66 is connected to the upper surface of the left or right leg portion 9, 10 to urge the lower end portion of the corresponding guide lever 40 rearward.

As shown in FIG. 5, a positioning recessed portion 64 is formed near the guide lever 40 on the bottom surface of each of the left and right leg portions 32, 33. The positioning recessed portion 64 is recessed upward in a direction substantially perpendicular to the bottom surface of each of the left and right leg portions 32, 33. The positioning recessed portion 64 is formed of a size to receive the positioning boss 11 of the image forming unit 2. A positioning protrusion 65 is disposed in the positioning recessed portion 64. The positioning protrusion 65 protrudes from the deepest portion or upper end of the positioning recessed portion 64 toward the image forming unit 2. The positioning protrusion 65 is formed of a size slightly greater than the lock hole 13 of the positioning boss 11.

The document base 25 of the scanner unit 3 is connected to the image forming unit 2 via the printer-side hinge 34. The axis of the printer-side hinge 34 extends in the width direction, and the scanner unit 3 is rotatable on the axis of the printer-side hinge 34 with respect to the image forming unit 2. Specifically, the scanner unit 3 oscillates between a closed position and an open position, in other words, opens and closes with respect to the image forming unit 2. When the scanner unit 3 is oscillated or opened or closed, the gripping portion 27 is held.

When the scanner unit 3 is in the closed position as shown in FIG. 1, the bottom surface of the leg portion 28 is in contact with the upper surface of the leg receiving portion 7. More specifically, the lower end 51 of the front end surface 47 of the left leg portion 32 is continuous with an upper end 55 of the front end surface 53 of the left leg receiving portion 9 and the front end surface 47 is aligned with the front end surface 53 as indicated by a solid line of FIG. 3. In addition, a lower end of the left side surface 57 of the left leg portion 32 is continuous with an upper end of the left side surface 58 of the left leg receiving portion 9, and the left side surface 57 is aligned with the left side surface 58 (see FIG. 2). In addition, a lower end of a right side surface of the left leg portion 32 is continuous with an upper end of a right side surface of the left leg receiving portion 9, and the right side surface of the left leg portion 32 is aligned with the right side surface of the left leg receiving portion 9 (see FIG. 2).

Similarly with the left leg portion 32 and the left leg receiving portion 9, the lower end 52 of the front end surface 48 of the right leg portion 33 is continuous with an upper end 56 of the front end surface 54 of the right leg receiving portion 10, and the front end surface 48 is aligned with the front end surface 54 as indicated by the solid line of FIG. 3. In addition, a lower end of the right side surface 59 of the right leg portion 33 is continuous with an upper end of the right side surface 60 of the right leg portion 10, and the right side surface 59 is aligned with the right side surface 60 (see FIG. 2). In addition, a lower end of a left side surface of the right leg portion 33 is continuous with an upper end of a left side surface of the right leg receiving portion 10, and the left side surface of the right leg portion 33 is aligned with the left side surface of the right leg receiving portion 10 (see FIG. 2). A height position of the top surface of the leg receiving portion 10 that includes a contact area between the leg portion 28 and the leg receiving portion 7 is hereinafter referred to as a contact position.

As shown in FIG. 2, an angle X formed by the left side surface 57 of the left leg portion 32 and the left side surface 58 of the left leg receiving portion 9, which are aligned with each other, and a horizontal plane as indicated by a broken line is set to at least 45 degrees. Similarly, an angle Y formed by the right side surface 59 of the right leg portion 33 and the right side surface 60 of the right leg receiving portion 60, which are aligned with each other, and the horizontal plane is set to at least 45 degrees. More specifically, the angle X and the angle Y are set equally, and the front shape of elements disposed below the document base 25 in the laser printer 1 is formed substantially symmetrically with respect to the vertical plane passing a center in the width direction. As described above, the left surface and the right surface of the printer housing 4 are vertical planes. Thus, when the image forming unit 2 including the printer housing 4 and the leg receiving portion 7 is viewed in its entirety, it is seen that an angle formed by a horizontal plane and each of the left and right surfaces of the image forming unit 2 where the carrying gripping portion 19 is formed is at least 45 degrees.

An ejection space 43 is defined by the right surfaces of the left leg portion 32 and the left receiving portion 9, the left surfaces of the right leg portion 33 and the right leg receiving portion 10, a part of the bottom surface of the document base 25 sandwiched by the left leg portion 32 and the right leg portion 33 in the width direction, the front surface of the rear leg receiving portion 15, and the sheet input portion 16 of the receiving portion 8. In other words, the receiving portion 8 is covered from above with the scanner unit 3 placed in the closed position. An ejection opening 42 is defined by the front ends of the right surfaces of the left leg portion 32 and the left leg receiving portion 9, the front ends of the left surfaces of the right leg portion 33 and the right leg receiving portion 10, a part of the front end on the bottom surface of the document base 25 sandwiched by the left leg portion 32 and the right leg portion 33 in the width direction, and the front end of the sheet input portion 16. The ejection opening 42 is shaped in a rectangle extending in the width direction in a front view. The ejection space 43 communicates with the ejection opening 42, from which a recording sheet ejected onto the sheet input portion 16, i.e. in the ejection space 43 can be taken out.

When the scanner unit 3 is in the open position as shown in FIG. 4, the bottom surface of the leg portion 28 is separated from the upper surface of the leg receiving portion 7. More specifically, the bottom surface of the leg portion 28 and the upper surface of the leg receiving portion 7 are disposed facing each other vertically, and the bottom surface of the leg portion 28 inclines upward toward the front (see FIG. 5). The receiving portion 8 is exposed upward toward the front.

Along with the movement of the scanner unit 3 between the open position and the closed position, the guide shafts 41 in the guide levers 40 slide in the corresponding guide grooves 14 of the lever supporting portions 12. More specifically, when the scanner unit 3 is placed in the open position, the guide shafts 41 are located at the rear ends of the guide grooves 14, and the guide levers 40 are disposed substantially perpendicularly to the bottom surface of the leg portion 28 (see FIG. 5). When the scanner unit 3 is moved to the closed position, the guide shafts 41 slide frontward in the corresponding guide grooves 14. Along with the sliding of the guide shafts 41, the guide levers 40 lean frontward. Along with the leaning of the guide levers 40, the bottom surface of the leg portion 28 approaches the upper surface of the leg receiving portion 7, the guide shaft 41 slides toward the front ends of the corresponding guide grooves 14, and the movement of the scanner unit 3 to the closed position is completed. In this manner, the leaning of the guide levers 40 or sliding of the guide shafts 41 in the guide grooves 14 is synchronous with the movement of the scanner unit 3 between the open position and the closed position. As the sliding of the guide shafts 41 is restricted within the guide grooves 14, the moving range of the scanner unit 3 is also restricted to the open position or the closed position. Thus, the scanner unit 3 is not unnecessarily opened over the open position.

As described above, the guide levers 40 are normally urged rearward at their guide shafts 41 by the coil springs 66. Thus, when the scanner unit 3 is moved to the closed position, it moves to the closed position opposing the urging force of the coil springs 66. This prevents the scanner unit 3 from slamming shut to the closed position.

As shown in FIG. 3, when the scanner unit 3 is moved to the closed position, the positioning bosses 11 of the left leg receiving portion 9 and the right leg receiving portion 10 are received in the corresponding positioning recessed portions 64, and the scanner unit 3 is positioned to the closed position. In this manner, the scanner unit 3 is accurately positioned at two places on the left and right sides. In addition, the positioning protrusions 65 in the positioning recessed portions 64 pass through the corresponding lock holes 13 and are accommodated in the positioning bosses 11. As the positioning protrusions 65 are formed of a size slightly greater than the corresponding lock holes 13, they are pressed into the lock holes 13. With this structure, the scanner unit 3 is locked in the closed position. This lock is to prevent the scanner unit 3 from unnecessarily being moved when the document holding cover 26 is moved. Thus, when an upward external force is applied to the scanner unit 3, for example, when the gripping portion 27 is held to move the scanner unit 3 upward, the press-fitting state of the positioning protrusions 65 in the positioning bosses 11 is released, and the scanner unit 3 can be moved from the closed position to the open position.

As shown in FIG. 1, the document holding cover 26 is thin and rectangular shaped in a plan view, and a plane shape of the document holding cover 26 is substantially equal to the plane shape of the document base 25. The document holding cover 26 is pivotally supported to the document base 25 at the rear end via a scanner-side hinge 44 (FIG. 3). A cover gripping portion 36 is provided at a substantially central portion of the front end of the document holding cover 26. The cover gripping portion 36 is recessed rearward. The document holding cover 26 is gripped by placing fingers at the cover gripping portion 36, and can be pivoted. The document holding cover 26 can be pivoted between a position to cover a glass surface (not shown) of the document base 25 and a position to expose the glass surface of the document base 25 upward. When image information of a document placed on the glass surface is read, the glass surface of the document base 25 is covered. The glass surface of the document base 25 is released when the document is removed.

An auto document feeder (ADF) 37 is disposed in a left half portion on the upper surface of the document holding cover 26. The ADF 37 is configured to automatically read image information of a document. The ADF 37 includes an ADF casing 38, a document feed roller (not shown), a document feed motor (not shown), and a document detecting sensor (not shown). The ADF casing 38 is box-shaped, and long in the front-rear direction. The document feed roller and the document feed motor are disposed in the ADF casing 38. A document tray 39 is disposed on the right side of the ADF casing 38 and in a substantially central portion in the vertical direction. The document tray 39 is shaped in a trapezoid narrowing to the right in a plan view. Documents are placed in stack on the document tray 39.

A document intake (not shown) for introducing a document inside the ADF casing 38 is formed on the right side of the ADF casing 38 and above the document tray 39. A document outlet (not shown) for ejecting the document from the ADF casing 38 is formed on the right side of the ADF casing 38 and below the document tray 39.

The scanner unit 3 has two modes to scan image information of a document: a normal mode and an auto mode.

When image information of a document is read in the normal mode, the user places his/her finger on the cover gripping portion 36, lifts up the document holding cover 26, and opens the glass surface of the document base 25. A document is placed on the glass surface, the document holding cover 26 is moved down to cover the glass surface of the document base 25. When one of the operation buttons 30 is pressed, the main-scanning motor (not shown) is driven. By the driving force of the main-scanning motor, the CCD sensor (not shown) is caused to scan from the left to the right, for example, to read image information of the document while facing the document placed on the glass surface.

When reading the image information of the document is completed, the glass surface of the document base 25 is opened and the document is removed. When the scanning is completed, the CCD sensor is automatically moved to a waiting position, e.g. a left end on the glass surface, and stands ready. In this manner, image information of a document at rest is read in the normal mode.

When image information of a document is read in the auto mode, the ADF 37 is used. When the document detecting sensor detects that the document is set on the document tray 39, the CCD sensor (not shown) is fixed in an auto reading position (not shown), in contrast to the normal mode. When one of the operation buttons 30 is pressed, the document feed motor (not shown) is driven. By a driving force of the document feed motor, the document feed roller (not shown) is rotated, and the document is rolled up by the document feed roller, and moved to the left. Then, the document is introduced into the ADF casing 38 via the document intake (not shown), and faces the CCD sensor so that image information of the document is read by the CCD sensor. After image information is read, the document is fed from the document outlet (not shown) to the right, and ejected onto the upper surface of the document holding cover 26.

As described above, the scanner unit 3 is provided with the gripping portion 27, and the left end portion 49 and the right end portion 50 are spaced away by the distance L measured upward from lower ends 51, 52 of the leg portion 28.

In other words, the gripping portion 27 is spaced away by the distance L from the contact position between the leg portion 28 and the leg receiving portion 7. When the gripping portion 27 is held, a hand 61 (FIG. 5) does not reach the contact position. Specifically, a predetermined interval $\alpha$ (FIG. 5) is provided between the contact position and the hand 61, and the user need only hold the gripping portion 27. As a result, the operability of opening and closing the scanner unit 3 can be improved.

As described above, both ends of the gripping portion 27 in the width direction are spaced away by the distance L measured upward from the lower end of the leg portion 28. Namely, both ends of the gripping portion 27 are disposed vertically overlapping the leg portion 28. Thus, the user can hold one end of the gripping portion 27 with one hand to open the scanner unit 3, while taking out a sheet ejected in the receiving portion 8 with the other hand. As a result, the operability can be further improved.

In addition, the leg portion 28 and the leg receiving portion 7 are provided together to sandwich the receiving portion 8. More specifically, in a plan view, the receiving portion 8 is sandwiched in the width direction between the left leg portion 32 and the right leg portion 33 in the leg portion 28, and sandwiched in the width direction between the left leg receiving portion 9 and the right leg receiving portion 10 in the leg receiving portion 7. Thus, the scanner unit 3 can be firmly placed in the closed position, in comparison with a case where the leg portion 28 and the leg receiving portion 7 are provided only on either the left side or the right side of the receiving portion 8, in other words, a case where the leg portion 28 and the leg receiving portion 7 are devoid of the left leg portion 32 and the left leg receiving portion 9 or the right leg portion 33 and the right leg receiving portion 10.

The ejection opening 42 is formed between the leg portion 28 and the leg receiving portion 7. Thus, a sheet ejected in the receiving portion 8 can be taken out via the ejection opening 42 without the need to move the scanner unit 3 from the closed position to the open position. As a result, the operability can be further improved.

The gripping portion 27 and the operation section 29 that the user often touches are disposed together in the laser printer 1. Thus, the operability can be further improved. Especially, as the gripping portion 27 protrudes from the document base 25, the operation section 29 disposed on the gripping portion 27 is easily accessible.

As shown in FIG. 3, the leg portion 28 protrudes frontward from its upper end to lower end. In a side view, a rearward recessed portion 45 is formed between the protruding portion of the leg portion 28 and each end of the gripping portion 27 in the width direction. Even when the hand comes in contact with the leg portion 28 at the time of holding the gripping portion 27, the hand is guided to the recessed portion 45. Thus, the hand can be prevented from reaching the contact position between the leg portion 28 and the leg receiving portion 7. As a result, the operability can be further improved.

The front end of the leg portion 28 or the front end surfaces 47, 48 are inclined surfaces protruding frontward from the upper end to the lower end. Compared with an uneven surface, the outward appearance of the leg portion 28 can reduce the tightness feeling, and the operability can be further improved.

In a side view, the front side of the leg portion 28 is shaped like a triangle whose bottom surface is regarded as a base. This shape increases the size of the contact area between the leg portion 28 and the leg receiving portion 7, which reduces the size of the laser printer 1 and improves the stiffness. For example, if the front side of the leg portion 28 is shaped such that the recessed portion 45 is U-shaped, in a side view, as indicated by an alternate long and short dashed line in an enlarged view in FIG. 3, a contact area of the leg portion 28 that contacts the leg receiving portion 7 is formed in a substantially flat plate form 46. In this case, to ensure stiffness to some extent, the flat plate form 46 should be thickened by thickness z. However, as the front side of the leg portion 28 is shaped like a triangle in a side view in this illustrative embodiment, creation of the flat plate form 46 can be omitted, and the size of the laser printer 1 can be reduced by thickness z of the flat plate form 46.

In addition, the front end surfaces 47, 48 of the leg portion 28 are coplanar with the front end surfaces 53, 54 of the leg receiving portion 7 when the scanner unit 3 is in the closed position. Thus, the lower ends 51, 52 of the leg portion 28 are not disposed forward of the front end surfaces 53, 54 of the leg receiving portion 7. When the user tries to hold the gripping portion 27 while the scanner unit 3 is in the closed position, the user can be prevented from reaching the lower ends 51, 52 of the leg portion 28, in other words, the contact position between the leg portion 28 and the leg receiving portion 7. Thus, the user can hold only the gripping portion 27. As a result, the operability can be improved.

To produce a similar effect, when the scanner unit 3 is in the closed position, the front ends 53, 54 of the leg receiving portion 7 may be shifted frontward of the front ends 47, 48 of the leg portion 28 as shown by a dotted line in FIG. 3. In other words, the front ends of the leg portion 28 may be disposed rearward of the front ends of the leg receiving portion 7.

The image forming unit 2 is provided with the carrying gripping portions 19 disposed below the contact position between the leg portion 28 and the leg receiving portion 7 when the scanner unit 3 is in the closed position. If the user tries to hold the scanner unit 3 disposed above the contact position in order to move the position of the laser printer 1, the scanner unit 3 will be opened, thus guiding the user to hold the carrying gripping portions 19. As the carrying gripping portions 19 are securely held, the laser printer 1 can be moved in a balanced manner.

As shown in FIG. 2, both side surfaces of the image forming unit 2 in the width direction where the carrying gripping portions 19 are provided are formed to have an angle of at least 45 degrees with respect to a horizontal plane. Both side surfaces of the image forming unit 2 function as sliding surfaces that are not easily held. Thus, the user can hold only the carrying gripping portions 19 on both side surfaces of the image forming unit 2. When the user tries to hold the scanner unit 3 disposed above the contact position, the scanner unit 3 is opened, thus guiding the user to hold the carrying gripping portions 19. As the carrying gripping portions 19 are securely held, the laser printer 1 can be moved in a balanced manner.

As described above, the angle between each side surface and the horizontal plane is at least 45 degrees, and thus each side surface functions as a sliding surface. When the laser printer 1 is moved, the carrying gripping portions 19 can be securely held.

Recording sheets are to be ejected from rear to front in the image forming unit 2. In other words, the recording sheets are to be ejected toward the user who holds the gripping portion 27. Thus, the user can reach an ejected sheet at the front of the gripping portion 27 and thus easily remove the sheet.

Although an illustrative embodiment and examples of modifications of the present invention have been described in detail herein, the scope of the invention is not limited thereto. It will be appreciated by those skilled in the art that various modifications may be made without departing from the scope of the invention. Accordingly, the illustrative embodiment and examples of modifications disclosed herein are merely exemplary. It is to be understood that the scope of the invention is not to be so limited thereby, but is to be determined by the claims which follow.

What is claimed is:

1. An image forming apparatus comprising:

an image forming unit including:

an image forming part configured to form an image on a recording sheet;

a receiving portion disposed above the image forming part and configured to receive a recording sheet on which an image is formed; and first and second contacted portions, the first contacted portion disposed on an opposite side on the image forming part from the second contacted portion; and an image reading unit disposed above the image forming unit and configured to open to expose the receiving portion and configured to close to cover the receiving portion, the image reading unit including:

an image reading portion configured to read image information on a document;

first and second contacting portions, the first contacting portion disposed on an opposite side of the image reading portion from the second contacting portion, the first and second contacting portions extending downward toward the image forming unit, and being configured to contact the first and second contacted portions, respectively, when the image reading unit is closed; and a first gripping portion having a bottom surface horizontally protruding frontward from the image reading portion, wherein a front end of the bottom surface of the first gripping portion is spaced apart by a distance (L) upward from a front end of the first contacting portion, and wherein the front end of the first contacting portion protrudes frontward more than a rear end of the bottom surface of the first gripping portion, the front end of the first contacting portion being opposite to the front end of the bottom surface of the first gripping portion.

2. The image forming apparatus according to claim 1, wherein the first and second contacting portions and the first and second contacted portions are disposed to sandwich the receiving portion to frame an ejection opening of the receiving portion from which a recording sheet is removed.

3. The image forming apparatus according to claim 1, wherein the first gripping portion includes an operation section configured to allow a user to operate the image forming apparatus.

4. The image forming apparatus according to claim 1, wherein each of the first and second contacting portions has a front inclined surface extending from the rear end of the bottom surface of the first gripping portion to the front end of a corresponding one of the first and second contacting portions.

5. The image forming apparatus according to claim 4, wherein, when the image reading unit is closed, the front inclined surface of each of the first and second contacting portions is coplanar with a surface of a corresponding one of the first and second contacted portions.

6. The image forming apparatus according to claim 4, wherein, when the image reading unit is closed, the front inclined surface of each of the first and second contacting portions is disposed further rearward than a surface of a corresponding one of the first and second contacted portions.

7. The image forming apparatus according to claim 1, wherein the image forming unit further includes a second gripping portion disposed below a contact position between each of the first and second contacting portions and the first and second contacted portions when the image reading unit is closed.

8. The image forming apparatus according to claim 7, wherein the second gripping portion is disposed on a side of the image forming unit including a sliding surface below the contact position.

9. The image forming apparatus according to claim 8, wherein an angle that the side forms with a horizontal plane is at least 45 degrees.

10. The image forming apparatus according to claim 1, wherein the receiving portion receives a recording sheet fed in the protruding direction of the first gripping portion when the image reading unit is closed.

11. The image forming apparatus according to claim 1, wherein the front end of the bottom surface of the first gripping portion protrudes frontward more than the front end of the first contacting portion.

12. The image forming apparatus according to claim 1, wherein the front end of the bottom surface of the first gripping portion is spaced apart by the distance (L) upward from a front end of the second contacting portion, and wherein the front end of the second contacting portion protrudes frontward more than the rear end of the bottom surface of the first gripping portion, which is opposite to the front end of the bottom surface of the first gripping portion.

13. The image forming apparatus according to claim 12, wherein the front end of the bottom surface of the first gripping portion protrudes frontward more than the front end of the second contacting portion.

14. The image forming apparatus according to claim 1, wherein the front end of the first contacting portion is horizontally disposed between a rear end of the bottom surface of the first gripping portion and the front end of the bottom surface of the first gripping portion.

15. An image forming apparatus comprising:

an image forming unit including:

an image forming part configured to form an image on a recording sheet;

a sheet receiving portion disposed above the image forming part and configured to receive a recording sheet on which an image is formed; and a leg receiving portion; and an image reading unit disposed above the image forming unit and configured to open to expose the sheet receiving portion and configured to close to cover the sheet receiving portion, the image reading unit including:

an image reading portion configured to read image information on a document;

a leg portion extending downward toward the image forming unit, wherein the leg portion and the leg receiving portion are configured such that the leg portion is received by the leg receiving portion when the image reading unit is closed; and an operation panel having a bottom surface horizontally protruding frontward from the image reading portion, wherein a front end of the bottom surface of the operation panel is spaced apart by a distance (L) upward from a front end of the leg portion, and wherein the front end of the leg portion protrudes frontward more than a rear end of the bottom surface of the operation panel, which is opposite to the front end of the bottom surface of the operation panel.

16. The image forming apparatus according to claim 15, wherein the leg portion has a front inclined surface extending from the rear end of the bottom surface of the operation panel to the front end of the leg portion.

17. The image forming apparatus according to claim 15, wherein, when the image reading unit is closed, the front inclined surface of the leg portion is coplanar with a surface of the leg receiving portion.

18. The image forming apparatus according to claim 15, wherein, when the image reading unit is closed, the front inclined surface of the leg portion is disposed rearward further than a surface of the leg receiving portion.

19. The image forming apparatus according to claim 15, the front end of the bottom surface of the operation panel protrudes frontward more than the front end of the leg portion.

20. An image forming apparatus comprising:

an image forming unit including:

an image forming part configured to form an image on a recording sheet;

a sheet receiving portion disposed above the image forming part and configured to receive a recording sheet on which an image is formed; and a leg receiving portion; and an image reading unit disposed above the image forming unit and configured to open to expose the sheet receiving portion and configured to close to cover the sheet receiving portion, the image reading unit including:

an image reading portion configured to read image information on a document;

a leg portion extending downward toward the image forming unit, wherein the leg portion and the leg receiving portion are configured such that the leg portion is received by the leg receiving portion when the image reading unit is closed; and an operation panel having a bottom surface horizontally protruding frontward from the image reading portion, wherein a front end of the bottom surface of the operation panel is spaced apart by a distance (L) upward from a front end of the leg portion, and wherein the front end of the leg portion is horizontally disposed between a rear end of the bottom surface of the operation panel and the front end of the bottom surface of the operation panel.

* * * * *